US007464563B2

(12) United States Patent
Park et al.

(10) Patent No.: US 7,464,563 B2
(45) Date of Patent: Dec. 16, 2008

(54) AIR-CONDITIONER HAVING A DUAL-REFRIGERANT CYCLE

(75) Inventors: Bong-Soo Park, Seoul (KR); Sai-Kee Oh, Gyeonggi-Do (KR); Chi-Woo Song, Incheon (KR); Song Choi, Seoul (KR); Baik-Young Chung, Incheon (KR); Se-Dong Chang, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 295 days.

(21) Appl. No.: 11/242,066

(22) Filed: Oct. 4, 2005

(65) Prior Publication Data

US 2006/0070391 A1 Apr. 6, 2006

(30) Foreign Application Priority Data

Oct. 5, 2004 (KR) ..... 10-2004-0079158

(51) Int. Cl.
*F25B 13/00* (2006.01)
*F25B 7/00* (2006.01)

(52) U.S. Cl. ..... 62/324.6; 62/335

(58) Field of Classification Search ..... 62/324.1, 62/324.6, 335

See application file for complete search history.

(56) References Cited

U.S. PATENT DOCUMENTS 4,104,890 A * 8/1978 Iwasaki ..... 62/324.1
4,149,389 A * 4/1979 Hayes et al. ..... 62/79
4,157,649 A * 6/1979 Bussjager et al. ..... 62/81
4,949,547 A * 8/1990 Shimizu ..... 62/79

FOREIGN PATENT DOCUMENTS

| | | | |
|---|---|---|---|
| EP | 0675331 | A2 | 10/1995 |
| EP | 0747643 | A1 | 12/1996 |
| EP | 0887599 | A1 | 12/1998 |
| EP | 1103770 | A1 | 5/2001 |
| EP | 1134515 | A1 | 9/2001 |
| EP | 1701112 | A1 | 9/2006 |
| JP | 2001-91074 | A | 4/2001 |

* cited by examiner

*Primary Examiner*—William E Tapolcai
(74) *Attorney, Agent, or Firm*—Birch, Stewart, Kolasch & Birch, LLP

(57) ABSTRACT

An air-conditioner having a dual-refrigerant cycle includes a primary refrigerant circuit heat-exchanged with outdoor air; a secondary refrigerant circuit heat-exchanged with indoor air to perform either a cooling operation or a heating operation; and a heat exchange unit disposed between the primary refrigerant circuit and the secondary refrigerant circuit to perform heat exchange therebetween, wherein the secondary refrigerant circuit includes a compressor for compressing a refrigerant circulating in the secondary refrigerant circuit. A condensing pressure of the primary refrigerant circuit is lowered during the hating operation and an evaporation pressure of the primary refrigerant circuit is increased to thereby enhance efficiency of the air-conditioner.

9 Claims, 7 Drawing Sheets

AIR-CONDITIONER HAVING A DUAL-REFRIGERANT CYCLE

BACKGROUND OF THE INVENTION

1. Field of the Invention

The present invention relates to an air-conditioner having a dual-refrigerant cycle and, more particularly, to an air-conditioner having a dual-refrigerant cycle capable of enhancing efficiency of an air-conditioner by compressing a refrigerant by using a compressor in a secondary refrigerant circuit.

2. Description of the Related Art

In general, a heat pump type air-conditioner, which performs both cooling and heating operation, can be used both as a cooling device by including an indoor heat exchanger and an outdoor heat exchanger and as a heating device by reversing flow of a refrigerant of a refrigerant cycle.

An air-conditioner having a dual-refrigerant cycle is constructed such that a refrigerant circulation circuit of the outdoor unit and an indoor unit is separated, so a primary refrigerant circuit is provided in the outdoor unit while a secondary refrigerant circuit is provided in the indoor unit. A heat exchange unit for heat exchanging is disposed between the primary and secondary refrigerant circuits.

FIG. 1 shows the construction of a refrigerant cycle of the air-conditioner having the secondary refrigerant circuit in accordance with a related art.

The related art air-conditioner includes: a primary refrigerant circuit 102 heat-exchanged with outdoor air; a secondary refrigerant circuit 104 heat-exchanged with indoor air to perform a cooling and heating operation; and a heat exchange unit 106 disposed between the primary and secondary refrigerant circuits 102 and 104 and performs heat exchanging therebetween.

The primary refrigerant circuit 102 includes an outdoor heat exchanger 108 heat-exchanged with outdoor air; a four-way valve 110 changing a flow of a refrigerant in a forward direction or in a reverse direction; an expansion valve 112 disposed at a refrigerant pipe 130 connected between the outdoor heat exchanger 108 and the heat exchange unit 106 and changing a refrigerant to have a low temperature and low pressure, a compressor 114 for compressing a refrigerant to have a high temperature and high pressure; and an accumulator 118 connected with a suction side of the compressor 114, separating the refrigerant into a gas and a fluid, and supplying a gaseous refrigerant to the compressor.

The secondary refrigerant circuit 104 includes a plurality of indoor heat exchangers 122 connected with the refrigerant pipe 120 constituting a closed circuit and heat-exchanged with indoor air, and a pump 124 installed at the refrigerant pipe 120 and pumping the refrigerant so as to circulate the secondary refrigerant circuit 104.

The refrigerant pipe 130 of the primary refrigerant circuit and the refrigerant pipe 120 of the secondary refrigerant circuit 104 are connected with the heat exchange unit 106, whereby the heat exchange unit 106 allows heat exchanging between the primary refrigerant circuit 102 and the secondary refrigerant circuit 104.

The operation of the related art air-conditioner constructed as described above will be explained as follows.

FIG. 2 is a graph showing pressure-enthalpy loops of the primary and secondary refrigerant circuits when the air-conditioner is operated for heating in accordance with the related art and FIG. 3 is a graph showing pressure-enthalpy loops of the primary and secondary refrigerant circuits when the air-conditioner is operated for cooling in accordance with the related art.

First, the operation of the primary refrigerant circuit during a heating operation is as follows.

A refrigerant is compressed in the compressor 114 (D→C process). The compressed refrigerant is heat-exchanged and condensed while passing through the four-way valve 110 and the heat exchange unit 106 (C→B process). And then, the refrigerant is changed to a low temperature and low pressure fluid refrigerant while passing through the expansion valve 112 (B→A process). Thereafter, the refrigerant absorbs latent heat of vaporization while passing through the outdoor heat exchanger 108 so as to be evaporated (A→D process). And, the evaporated refrigerant is introduced into the accumulator 118 through the four-way valve 110 so as to be separated into a gas and a fluid, and the gaseous refrigerant is supplied to the compressor 114. In this manner, the refrigerant is circulated.

The operation of the secondary refrigerant circuit during a heating operation is as follows.

A refrigerant flowing through the refrigerant pipe 120 performs a heating operation while passing through the indoor heat exchangers 122 (4→1 process). After finishing the heating operation in the indoor heat exchangers 122, the refrigerant is pumped by the pump 124 to obtain a driving force to circulate through the refrigerant pipe 120 (1→2 process). The pumped refrigerant is heat-exchanged with the primary refrigerant circuit 102 while passing through the heat exchange unit 106 (2→3 process). The heat-exchanged refrigerant is supplied to the indoor heat exchangers 122 (3→4 process).

The operation of the primary refrigerant circuit during a cooling operation is as follows.

When the four-way valve 110 is operated, the refrigerant flow passage is changed and the refrigerant is compressed in the compressor 114 (D→C process). The compressed refrigerant is heat-exchanged and condensed while passing through the four-way valve 110 and then the outdoor heat exchanger 108 (C→B process). The condensed refrigerant is expanded to be a low temperature and low pressure liquid refrigerant while passing through the expansion valve 112 (B→A). The expanded refrigerant is heat-exchanged while passing through the heat exchange unit 106 to absorb latent heat of evaporation so as to be evaporated (A→D process). And then, the refrigerant is separated into a gas and a fluid while passing through the four-way valve 110 and the accumulator 118, and the gaseous refrigerant is sucked into the compressor 114. These processes are repeatedly performed.

The operation of the secondary refrigerant circuit during a cooling operation is as follows.

The refrigerant absorbs latent heat of evaporation while passing through the indoor heat exchanger 122, thereby performing the cooling operation (2→3 process). And then, the refrigerant is moved into the heat exchange unit 106 (3→4 process). Thereafter, the refrigerant is heat-exchanged with the primary refrigerant circuit 102 while passing through the heat exchange unit 106 so as to be condensed (4→1 process). The condensed refrigerant is pumped by the pump 124 to obtain a driving force to circulate through the refrigerant pipe 120 (1→2 process).

However, the related art air-conditioner has the following problems.

That is, since the condensing process (C→B process) of the primary refrigerant circuit 1020 during the heating operation has a higher pressure than that of the evaporating process (4→1 process) of the secondary refrigerant circuit 104 for actually performing the heating operation in a room, efficiency of the primary refrigerant circuit is degraded.

In addition, since the evaporation process (A→D) of the primary refrigerant circuit 102 during the cooling operation generates evaporation at a lower pressure than that of the condensing process (2→3) of the secondary refrigerant circuit 104 for performing the actual cooling operation, efficiency of the primary refrigerant circuit is degraded.

Accordingly, although the related art air-conditioner having the dual-refrigerant cycle is advantageous in that the compressor oil is not introduced toward the secondary refrigerant circuit 104 because the primary and secondary refrigerant circuits 102 and 104 are separated, the condensing pressure of the primary refrigerant circuit 102 is higher than the secondary refrigerant circuit 104 or the evaporation pressure of the primary refrigerant circuit 102 is lower than the condensing pressure of the secondary refrigerant circuit 104, resulting in degradation of efficiency of the air-conditioner.

BRIEF DESCRIPTION OF THE INVENTION

Therefore, an object of the present invention is to provide an air-conditioner having a dual-refrigerant cycle capable of enhancing efficiency by lowering a high pressure of a primary refrigerant circuit during a heating operation and increasing a low pressure of the primary refrigerant circuit during a cooling operation by installing a compressor in a secondary refrigerant circuit.

To achieve these and other advantages and in accordance with the purpose of the present invention, as embodied and broadly described herein, there is provided an air-conditioner having a dual-refrigerant cycle including: a primary refrigerant circuit heat-exchanged with outdoor air; a secondary refrigerant circuit heat-exchanged with indoor air to perform either a cooling operation or a heating operation; and a heat exchange unit disposed between the primary refrigerant circuit and the secondary refrigerant circuit to perform heat exchange therebetween, wherein the secondary refrigerant circuit includes a compressor for compressing a refrigerant circulating in the secondary refrigerant circuit.

The secondary refrigerant circuit includes: a plurality of indoor heat exchangers heat-exchanged with indoor air; a second compressor installed at a refrigerant pipe connected with the indoor heat exchangers and compressing a refrigerant to circulate in the secondary refrigerant circuit; and a second four-way valve is disposed at a refrigerant pipe connected with a discharge side of the compressor and changing a flow of the refrigerant in a forward direction or in a reverse direction.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The air-conditioner having a secondary refrigerant circuit in accordance with a preferred embodiment of the present invention will now be described with reference to the accompanying drawings.

There can be several embodiments for the air-conditioner having the secondary refrigerant circuit, of which the most preferred one will be described.

Figure 1:
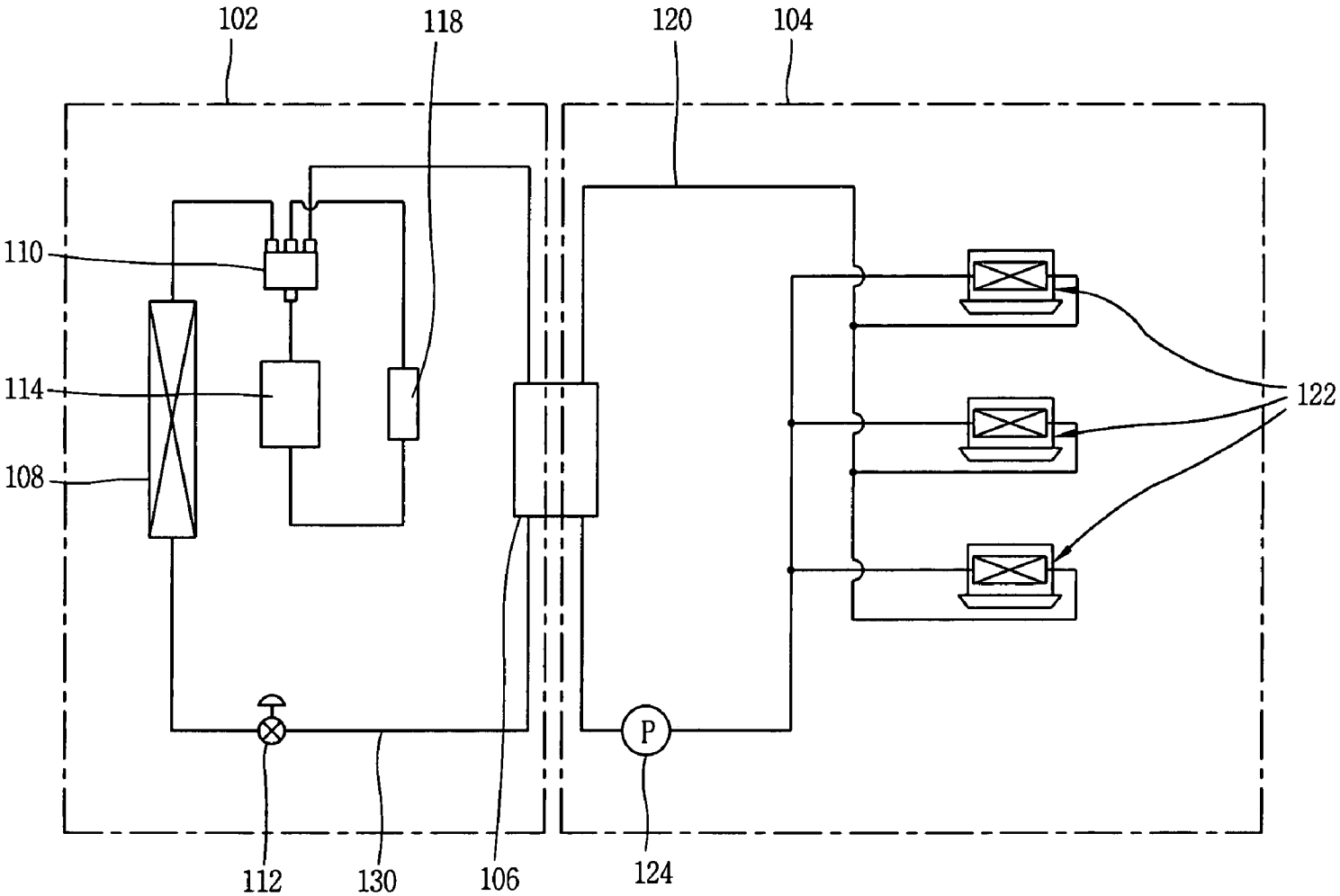
FIG. 1 CONVENTIONAL ART
FIG. 1 shows the construction of a refrigerant cycle of an air-conditioner having a dual-refrigerant cycle in accordance with a related art.
Figure 2:
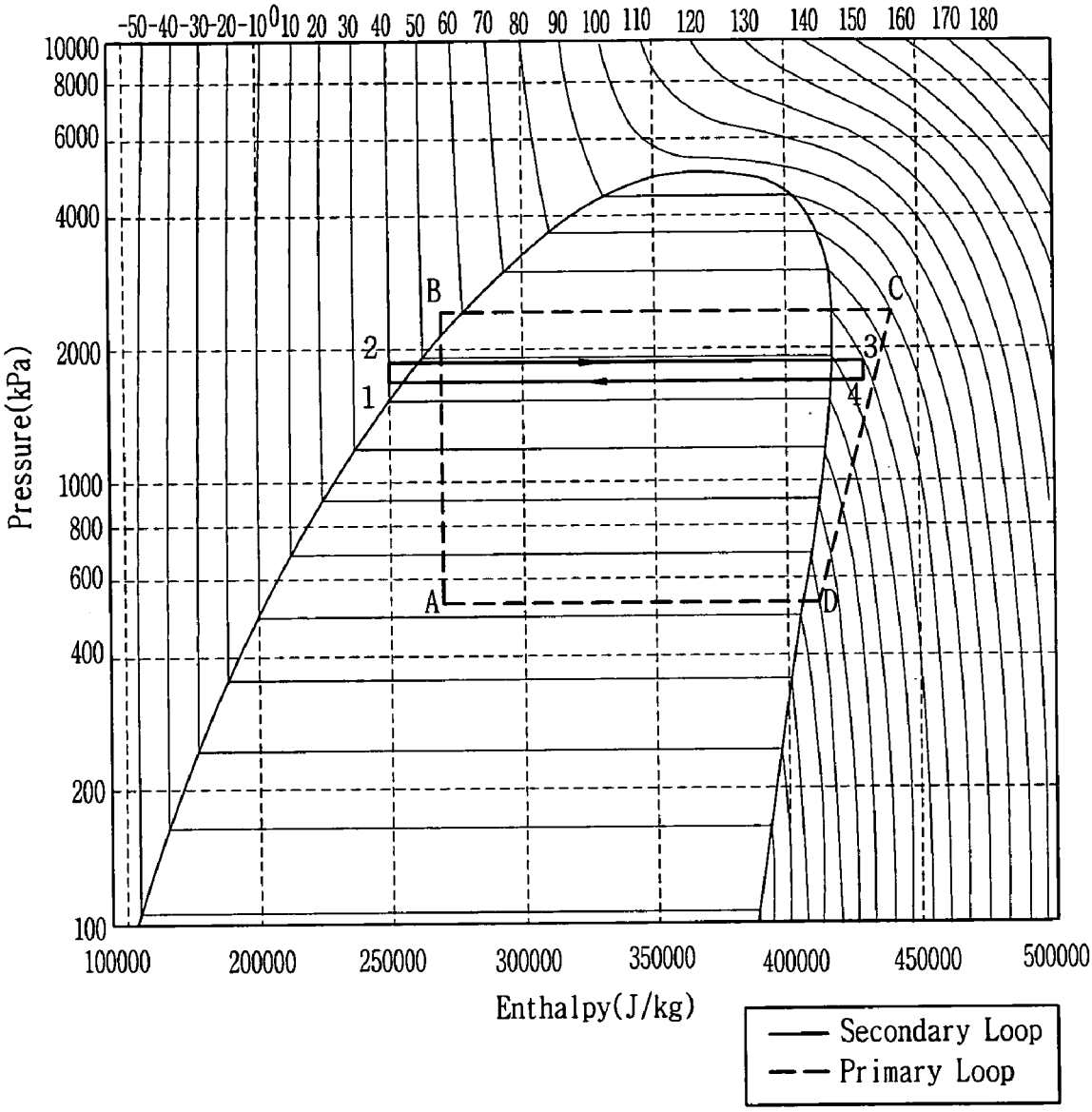
FIG. 2 CONVENTIONAL ART
FIG. 2 is a graph showing pressure-enthalpy loops of the primary and secondary refrigerant circuits when the air-conditioner is operated for heating in accordance with the related art.
Figure 3:
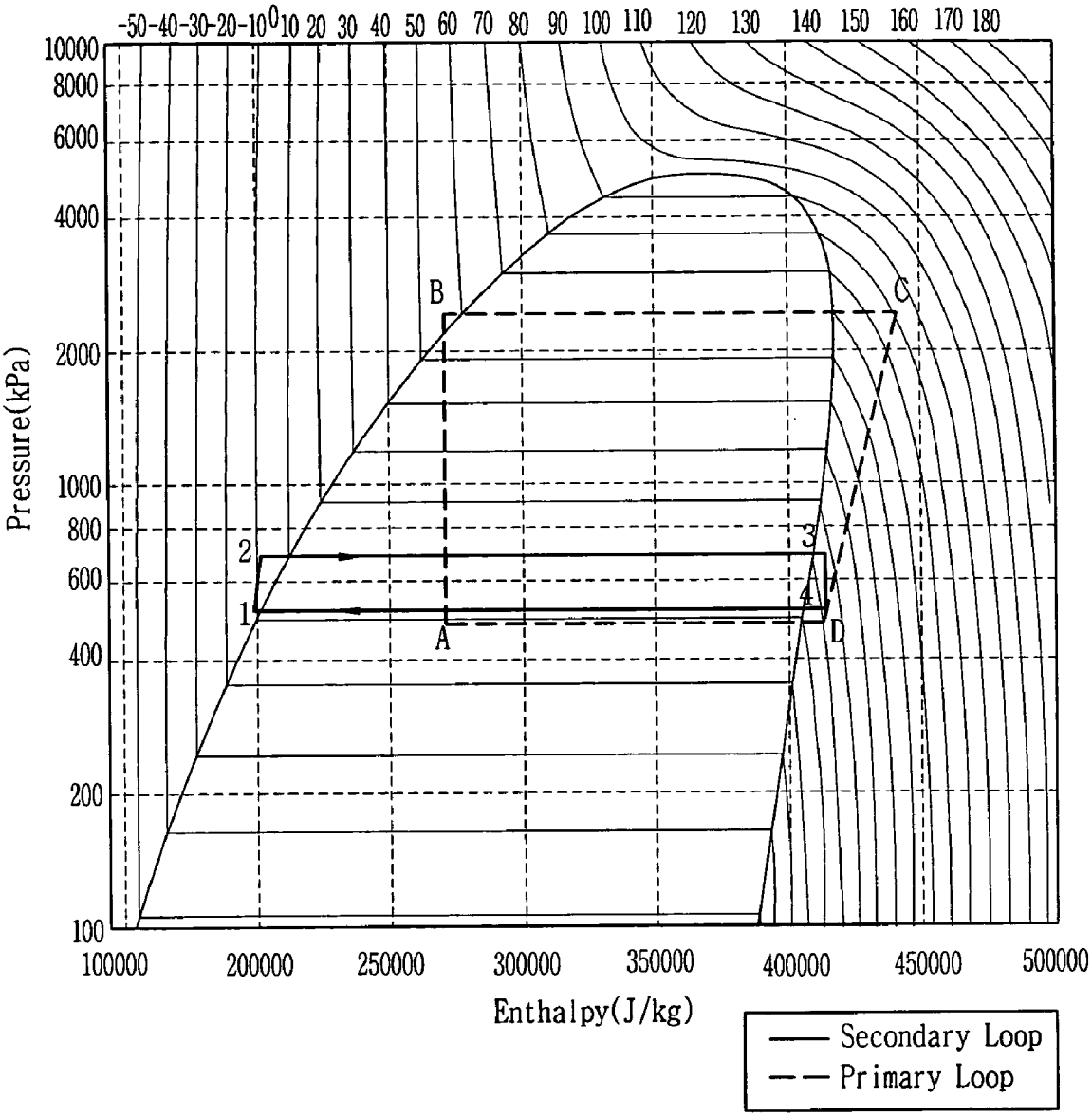
FIG. 3 CONVENTIONAL ART
FIG. 3 is a graph showing pressure-enthalpy loops of the primary and secondary refrigerant circuits when the air-conditioner is operated for cooling in accordance with the related art.
Figure 4:
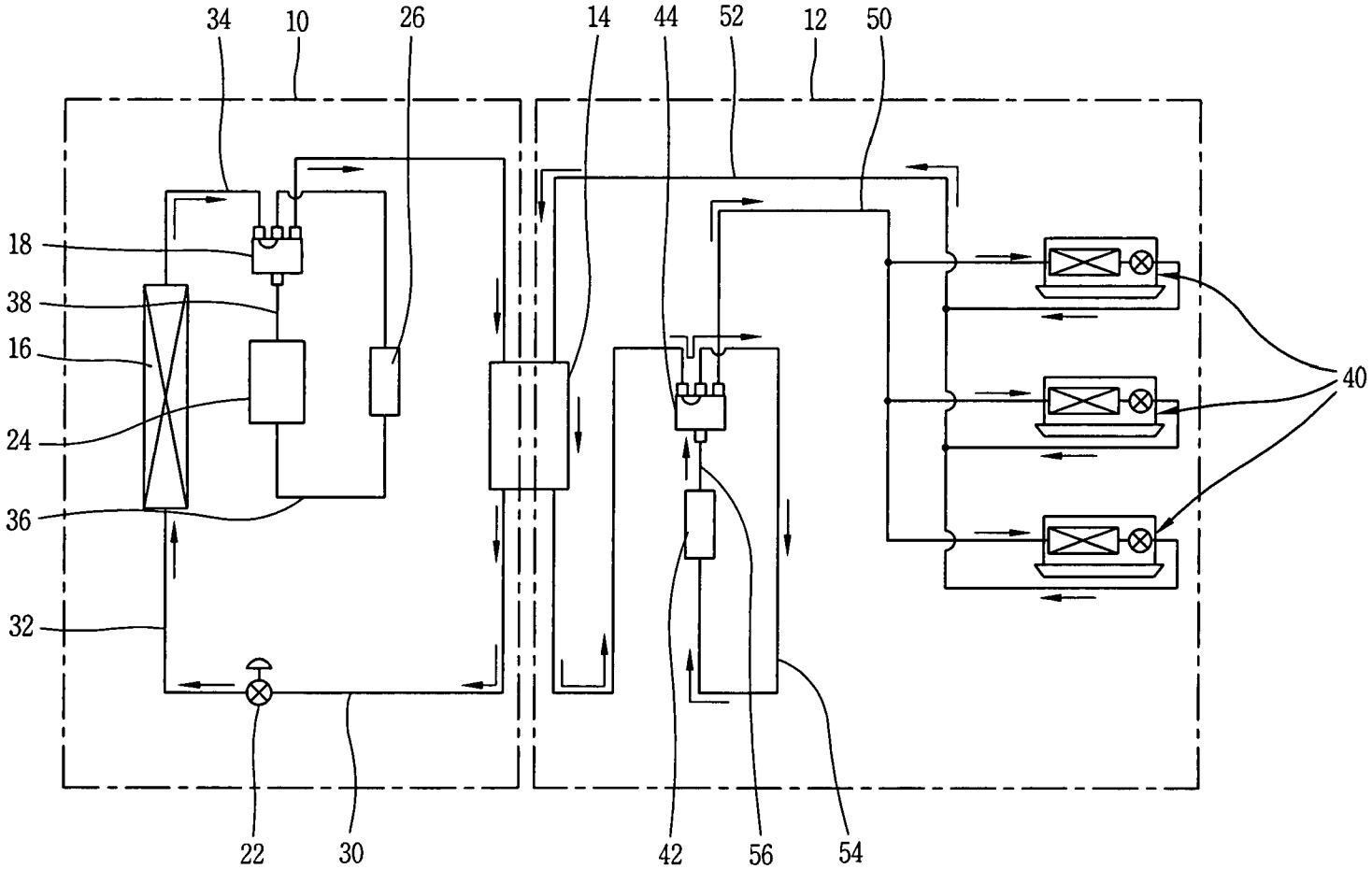
FIG. 4 shows the construction of a refrigerant cycle of an air-conditioner having a dual-refrigerant cycle in accordance with the present invention.

FIG. 4 shows the construction of a refrigerant cycle of an air-conditioner having a dual-refrigerant cycle in accordance with the present invention.

The air-conditioner in accordance with the present invention includes a primary refrigerant circuit 10 heat-exchanged with outdoor air, a secondary refrigerant circuit 12 disposed in a room and performing a cooling and heating operation in the room; and a heat exchange unit 14 disposed between the primary and secondary refrigerant circuits 10 and 12 and performing heat exchanging therebetween.

The primary refrigerant circuit 10 includes an outdoor heat exchanger 16 heat-exchanged with outdoor air, a first four-way valve 18 for changing a flow of a refrigerant in a forward direction or in a reverse direction, an expansion valve 22 for decompressing and expanding the refrigerant, a first compressor 24 for compressing the refrigerant to have a high temperature and high pressure, and an accumulator 26 connected with a suction side of the first compressor 24, separating the refrigerant into a gas and a fluid, and supplying the gaseous refrigerant to the first compressor 24.

A refrigerant pipe of the primary refrigerant circuit 10 includes a first pipe 30 connected with an expansion valve 22 by way of the first four-way valve 18 and the heat exchange unit 14, a second pipe 32 connected between the expansion valve 22 and the outdoor heat exchanger 16; a third pipe 34 connected between the outdoor heat exchanger 16 and the first four-way valve 18, a fourth pipe 36 connected between the first four-way valve 18 and the suction side of the first compressor 24, and a fifth pipe 38 connected between a discharge side of the first compressor 24 and the first four-way valve 18.

The secondary refrigerant circuit 12 includes a plurality of indoor heat exchangers 40 heat-exchanged with indoor air, a second compressor 42 for compressing the refrigerant so as to be circulated in the secondary refrigerant circuit 12, and a second four-way valve 44 disposed at a refrigerant pipe connected with a discharge side of the second compressor 42 and changing a flow of the refrigerant in the forward direction or in the reverse direction.

A refrigerant pipe of the secondary refrigerant circuit 12 includes a first pipe 50 connected between the second four-way valve 44 and the indoor heat exchangers 40, a second pipe 52 connected between the indoor heat exchanger 40 and the second four-way valve 44 by way of the heat exchange unit 14, a third pipe 54 connected between the second four-way valve 44 and a suction side of the second compressor 42, and a fourth pipe 56 connected between the discharge side of the second compressor 42 and the second four-way valve 42.

As the second compressor 42, a non-oil compressor which does not use oil is preferably used in order to prevent introduction of oil into the indoor heat exchanger 40. The second compressor 42 compresses a gaseous refrigerant and discharges the gaseous refrigerant.

The heat exchange unit 14 is connected with the first pipe 30 of the primary refrigerant circuit 10 and the second pipe 52 of the secondary refrigerant circuit 12, so that heat can be exchanged between the primary refrigerant circuit 10 and the secondary refrigerant circuit 12.

Figure 5:
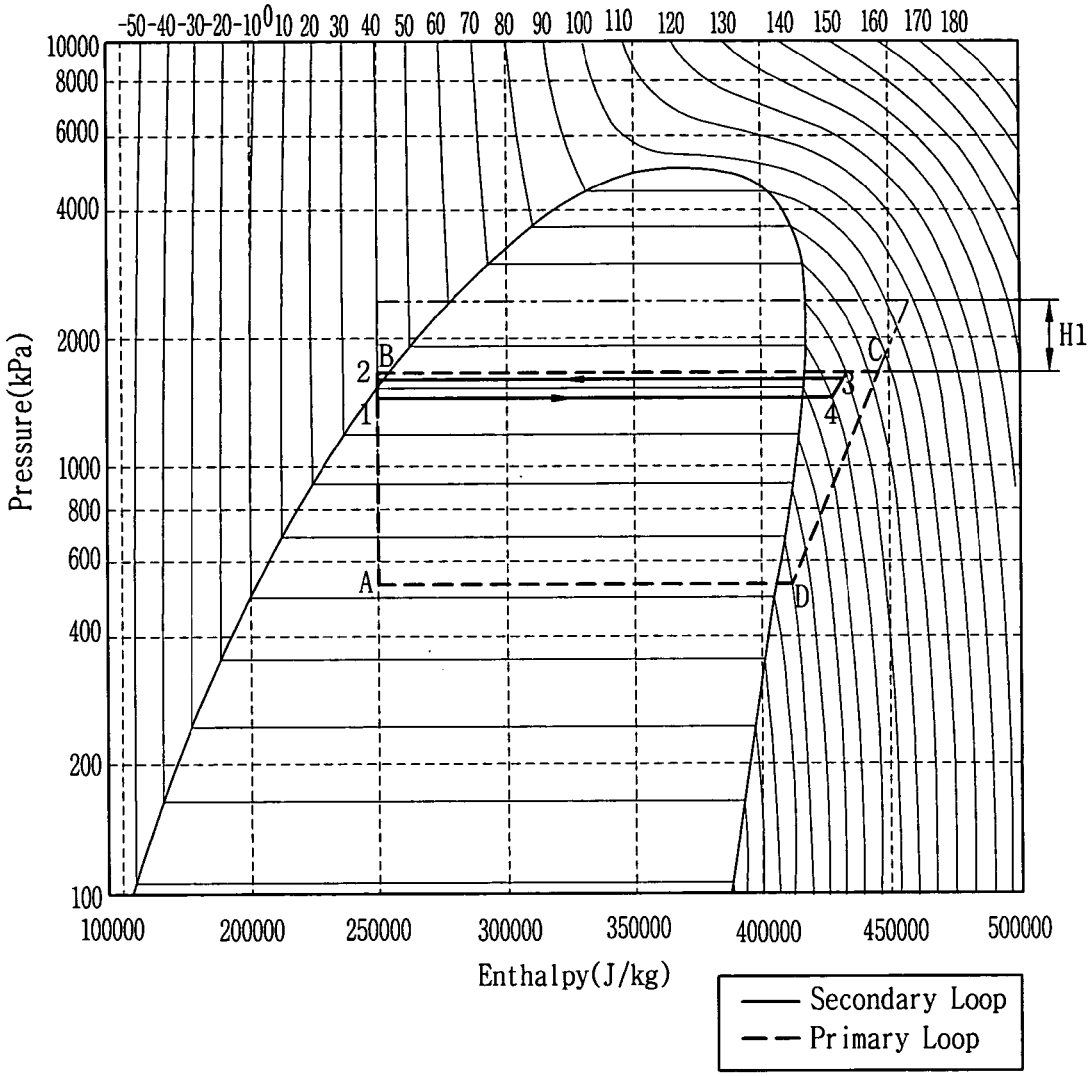
FIG. 5 is a graph showing pressure-enthalpy loops of the primary and secondary refrigerant circuits when the air-conditioner is operated for heating in accordance with the present invention.

FIG. 5 is a graph showing pressure-enthalpy loops of the primary and secondary refrigerant circuits when the air-conditioner is operated for heating in accordance with the present invention.

First, the operation of the primary refrigerant circuit 10 during the heating operation is as follows.

When the first four-way valve 18 is operated, the third pipe 34 and the fourth pipe 36 and the first pipe 30 and the fifth pipe 38 communicate with each other.

In this state, when the first compressor 24 is driven, refrigerant in the first compressor is compressed (D→C process). The compressed refrigerant is heat-exchanged and condensed while passing through the heat exchange unit 14 by way of the first four-way valve 18 (C→B process). And then, the condensed refrigerant is decompressed and expanded while passing through the expansion valve 22 so as to be changed into a liquid refrigerant state (B→A process). And then, the liquid refrigerant absorbs latent heat of evaporation while passing through the outdoor heat exchanger 16 so as to be evaporated (A→D process). The evaporated refrigerant is introduced to the accumulator 26 through the first four-way valve 18, and separated into a gas and a fluid in the accumulator 26, and then, the gaseous refrigerant is supplied to the first compressor 24.

The operation of the secondary refrigerant circuit 12 during the heating operation is as follows.

The second four-way valve 44 is operated to make the second and third pipes 52 and 54 and the first and fourth pipes 50 and 56 communicate with each other.

In this state, the second compressor 42 is driven to compress a refrigerant (4→3 process). The compressed refrigerant is introduced into the indoor heat exchangers 40 so as to be condensed. At this time, the indoor heat exchangers 40 are heat-exchanged with indoor air to perform the heating operation (3→2 process). And then, the condensed refrigerant is supplied to the heat exchange unit 14 (2→1 process). While passing through the heat exchange unit 14, the refrigerant is heat-exchanged with the primary refrigerant circuit 10 and evaporated (1→4 process). The refrigerant which has passed through the heat exchange unit 14 is sucked into the second compressor 42 through the second four-way valve 44.

Thus, during the heating operation, the condensing process (C→B process) of the primary refrigerant circuit 10 is performed during the process (1→4 process) for heat-exchanging by the heat exchanging unit 14 with the condensed refrigerant while performing the heating operation of the secondary refrigerant circuit 12, so, as shown in FIG. 5, efficiency of the air-conditioner can be enhanced as much as the condensing pressure lowered by a pressure value (H1) compared with the related art.

Figure 6:
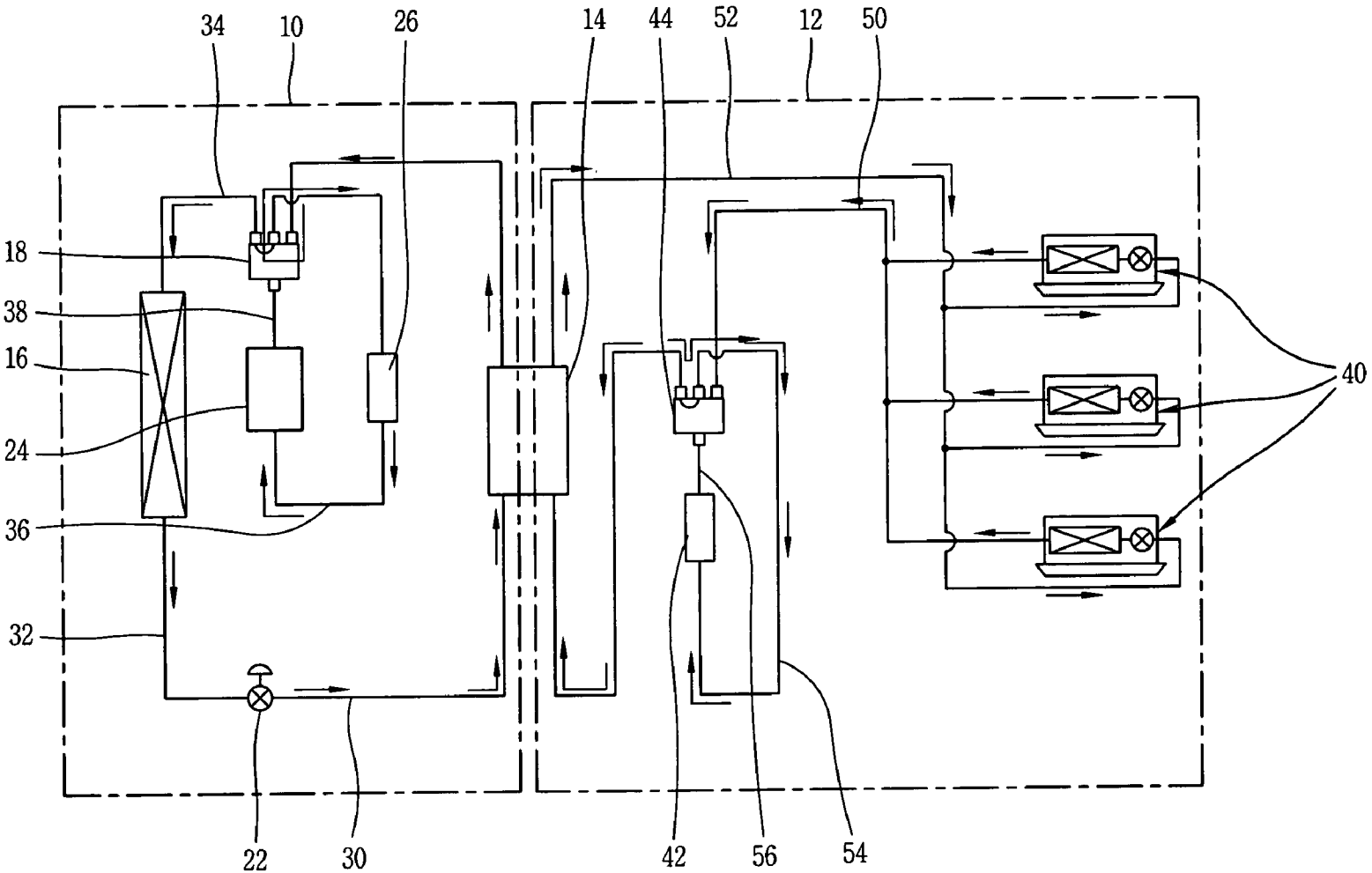
FIG. 6 shows an operational state when the air-conditioner having the dual-refrigerant cycle is operated for a cooling operation.
Figure 7:
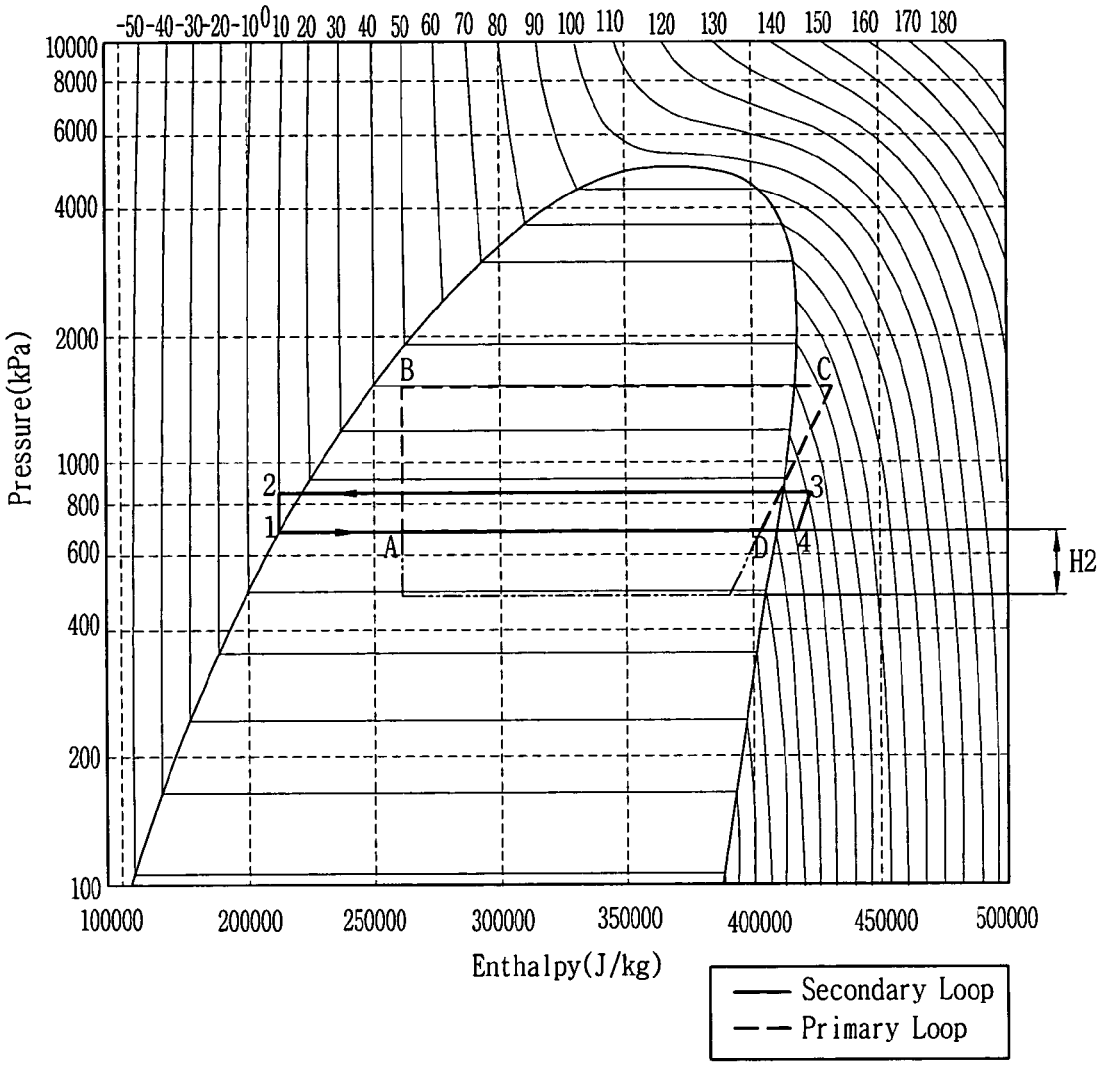
FIG. 7 is a graph showing pressure-enthalpy loops of the primary and secondary refrigerant circuits when the air-conditioner is operated for cooling in accordance with the present invention.

FIG. 6 shows an operational state when the air-conditioner having the dual-refrigerant cycle is operated for a cooling operation, and FIG. 7 is a graph showing pressure-enthalpy loops of the primary and secondary refrigerant circuits when the air-conditioner is operated for cooling in accordance with the present invention.

The operation of the primary refrigerant circuit 10 during the cooling operation of the air-conditioner is as follows.

The first four-way valve 18 is operated to make the first and fourth pipes 30 and 36 and the third and fifth pipes 34 and 38 communicate with each other.

In this state, the first compressor 24 is driven to compress a refrigerant (D→C process). The compressed refrigerant is heat-exchanged with outdoor air while passing through the outdoor heat exchanger 16 and then condensed (C→B process). The condensed refrigerant is decompressed and expanded while passing through the expansion valve 22 (B→A process). And then, the decompressed and expanded refrigerant is heat-exchanged with the secondary refrigerant circuit 12 while passing through the heat exchange unit 14, absorbing the latent heat so as to be evaporated (A→D process). And then, the refrigerant, which has passed through the heat exchange unit 14, is separated into a gas and a fluid while passing through the accumulator 26 by way of the first four-way valve 18, and the gaseous refrigerant is sucked into the first compressor 24. These processes are repeatedly performed.

The operation of the secondary refrigerant circuit 12 during the cooling operation is as follows.

The second four-way valve 44 is operated to make the first and third pipes 50 and 54 and the second and fourth pipes 52 and 56 communicate with each other.

In this state, the second compressor 42 is driven to compress a refrigerant (4→3 process). The compressed refrigerant is heat-exchanged with the primary refrigerant circuit 10 while passing through the heat exchange unit 14, so as to be condensed (3→2 process). The condensed refrigerant is moved into the indoor heat exchanger 40 so as to be expanded to a low pressure state (2→1 process). And then, the refrigerant absorbs the latent heat while passing through the indoor heat exchanger 40, so as to be evaporated (1→4 process). At this time, the indoor heat exchange 40 is heat-exchanged with indoor air, performing the cooling operation. The evaporated refrigerant is sucked into the second compressor by way of the second four-way valve 44. These processes are repeatedly performed.

Thus, during the cooling operation of the air-conditioner, the evaporation process (A→D process) of the primary refrigerant circuit 10 is performed while heat-exchanging with the refrigerant which has been pressed in the second compressor 42 of the secondary refrigerant circuit 12, so that the evaporation pressure is increased as much as a pressure value (H2) and the condensing pressure during the condensing process (B→C process) is the same as that of the related art. Thus, efficiency of the air-conditioner can be enhanced as much as the increased evaporation pressure.

As so far described, the air-conditioner having the dual-refrigerant cycle in accordance with the present invention has many advantages.

That is, for example, because the compressor is provided in the secondary refrigerant circuit heat-exchanged with indoor air to compress the refrigerant circulating in the secondary refrigerant circuit, the condensing pressure of the primary refrigerant circuit can be lowered during the heating operation and the evaporation pressure of the primary refrigerant circuit is increased during the cooling operation. Accordingly, the efficiency of the air-conditioner can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An air-conditioner having a dual-refrigerant cycle comprising:

a primary refrigerant circuit which includes a first compressor, an outdoor heat exchanger connected to the first compressor and heat-exchanged with outdoor air, and an expansion valve for expanding a refrigerant;

a secondary refrigerant circuit which includes an indoor heat exchanger heat-exchanged with indoor air, and a second compressor connected to the indoor heat exchanger for circulating the refrigerant; and a heat exchange unit disposed between the primary refrigerant circuit and the secondary refrigerant circuit to perform heat exchange therebetween, wherein in a cooling operation, the refrigerant in the primary refrigerant circuit, having been compressed in the first compressor, is sucked back to the first compressor for circulation sequentially via the outdoor heat exchanger, the expansion valve and the heat exchange unit, wherein in the cooling operation, the refrigerant in the secondary refrigerant circuit, having been compressed in the second compressor, is sucked back to the second compressor for circulation sequentially via the heat exchange unit and the indoor heat exchanger, wherein the refrigerant in the primary refrigerant circuit and the refrigerant in the secondary refrigerant circuit are introduced into the heat exchange unit in the same direction and discharged out of the heat exchange unit in the same direction during the cooling operation, wherein the primary refrigerant circuit further includes a first four-way valve connected to a discharge side of the first compressor to change a flow of the refrigerant, and the second refrigerant circuit further includes a second four-way valve connected to a discharge side of the second compressor to change a flow of the refrigerant, wherein in a heating operation, the refrigerant in the primary refrigerant circuit, having been compressed in the first compressor, is sucked back to the first compressor for circulation sequentially via the first four-way valve, the heat exchange unit, the expansion valve, the outdoor heat exchanger and the first four-way valve, wherein in the heating operation, the refrigerant in the secondary refrigerant circuit, having been compressed in the second compressor, is sucked back to the second compressor for circulation sequentially via the second four-way valve, the indoor heat exchanger, the heat exchange unit and the second four-way valve, and wherein the refrigerant in the primary refrigerant circuit and the refrigerant in the secondary refrigerant circuit are introduced into the heat exchange unit in the same direction and discharged out of the heat exchange unit in the same direction during the heating operation.

2. The air-conditioner of claim 1, wherein as the second compressor, a non-oil compressor is used.

3. The air-conditioner of claim 1, wherein the second compressor compresses a gaseous refrigerant and discharges the compressed gaseous refrigerant.

4. The air-conditioner of claim 1, wherein as the second compressor, a non-oil compressor is used.

5. The air-conditioner of claim 1, wherein the second compressor compresses a gaseous refrigerant and discharges the gaseous refrigerant.

6. The air-conditioner of claim 1, wherein the refrigerant pipe of the primary refrigerant circuit comprises:

a first pipe connected between the four-way valve and the indoor heat exchangers;

a second pipe connected between the indoor heat exchanger and the second four-way valve by way of the heat exchange unit;

a third pipe connected between the second four-way valve and a suction side of the second compressor; and a fourth pipe connected between a discharge side of the compressor and the second four-way valve.

7. The air-conditioner of claim 6, wherein the second four-way valve allows the second and third pipes and the first and fourth pipes to communicate with each other during the heating operation.

8. The air-conditioner of claim 6, wherein the second four-way valve allows the first and third pipes and the second and fourth pipes to communicate with each other during the heating operation.

9. The air-conditioner of claim 6, wherein the heat exchange unit is connected with the first pipe of the primary refrigerant circuit and the second pipe of the secondary refrigerant circuit.

* * * * *